US006860208B2

(12) United States Patent
Blomquist

(10) Patent No.: US 6,860,208 B2
(45) Date of Patent: Mar. 1, 2005

(54) NITROCELLULOSE GAS GENERATING MATERIAL FOR A VEHICLE OCCUPANT PROTECTION APPARATUS

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/754,805

(22) Filed: Jan. 4, 2001

(65) Prior Publication Data

US 2002/0084010 A1 Jul. 4, 2002

(51) Int. Cl.[7] ..... C06D 5/00; C06B 25/22
(52) U.S. Cl. ..... 102/530; 149/99; 149/100
(58) Field of Search ..... 149/99, 100; 102/530

(56) References Cited

U.S. PATENT DOCUMENTS

| | | | | | |
|---|---|---|---|---|---|
| 3,890,175 | A | * | 6/1975 | Lavitt | 149/100 |
| 3,895,821 | A | * | 7/1975 | Schotthoefer et al. | 280/741 |
| 3,899,973 | A | * | 8/1975 | Brocart | 102/275.5 |
| 3,960,621 | A | | 6/1976 | Whitworth et al. | |
| 4,031,172 | A | | 6/1977 | Zeigler | |
| 4,082,583 | A | * | 4/1978 | Mosher | 149/100 |
| 4,120,153 | A | | 10/1978 | Schaffing | |
| 4,326,901 | A | * | 4/1982 | Leneveu et al. | 149/12 |
| 4,842,658 | A | * | 6/1989 | Boileau et al. | 149/96 |
| 5,125,684 | A | * | 6/1992 | Cartwright | 149/19.8 |
| 5,205,983 | A | | 4/1993 | Camp et al. | |
| 5,325,782 | A | | 7/1994 | Strauss et al. | |
| 5,487,851 | A | * | 1/1996 | Dillehay et al. | 264/3.3 |
| 5,574,240 | A | | 11/1996 | Cartwright | |
| 5,626,360 | A | * | 5/1997 | Lauritzen et al. | 280/741 |
| 5,716,557 | A | | 2/1998 | Strauss et al. | |
| 5,763,814 | A | * | 6/1998 | Avory et al. | 102/202 |
| 5,798,481 | A | | 8/1998 | Manning et al. | |
| 5,821,448 | A | * | 10/1998 | Hamilton et al. | 102/289 |
| 6,066,213 | A | * | 5/2000 | Williams et al. | 149/100 |

OTHER PUBLICATIONS

Meyer, Handbook of Explosives, (1977) Verlag Chemie, pp. 132–134, 247–248 and 238.*

* cited by examiner

*Primary Examiner*—Aileen Felton
(74) *Attorney, Agent, or Firm*—Tarolli, Sundheim, Covell & Tummino L.L.P.

(57) ABSTRACT

An apparatus comprises a vehicle occupant protection device (14) and a gas generating material (18). The gas generating material (18), when ignited, produces a combustion gas that actuates the vehicle occupant protection device (14). The gas generating material (18) comprises a single-base nitrocellulose composition that includes greater than 2%, by weight of the single-base composition, stabilizer. The stabilizer is a urea of an aromatic amine.

4 Claims, 4 Drawing Sheets

NITROCELLULOSE GAS GENERATING MATERIAL FOR A VEHICLE OCCUPANT PROTECTION APPARATUS

FIELD OF THE INVENTION

The present invention relates to a non-azide based gas generating material. The gas generating material of the present invention is particularly useful for inflating an inflatable vehicle occupant protection device.

BACKGROUND OF THE INVENTION

An air bag is inflated to help protect an occupant of a vehicle upon occurrence of a vehicle collision. When the vehicle experiences a collision-indicating condition of at least a predetermined threshold level, an igniter is actuated so as to ignite a gas generating material. As the generating material burns, it generates a volume of inflation gas. The inflation gas is directed into the air bag to inflate the air bag. When the air bag is inflated, it expands into the vehicle occupant compartment and helps to protect the vehicle occupant.

Another apparatus that protects an occupant of a vehicle upon the occurrence of a vehicle collision is a seat belt associated with a seat belt pretensioner. The pretensioner can be actuated by a gas provided by a gas generator. When the vehicle experiences a collision indicating-condition for which pretensioning of the seat belt is desired, an igniter is actuated so as to ignite a gas generating material. As the generating material burns, it generates a volume of gas. The gas is directed against a mechanism, e.g., a piston, connected to a cable. The seat belt is then tightened against the vehicle occupant.

It is known to use an energetic cellulose, such as nitrocellulose (NC), as a gas generating material in an vehicle occupant protection apparatus. One limitation to using nitrocellulose as a gas generating material in a vehicle occupant protection apparatus is that nitrocellulose decomposes over time.

A stabilizer can be combined with nitrocellulose to retard the decomposition of nitrocellulose at ambient temperatures (i.e., about 25° C.). A commonly used stabilizer is diphenylamine (DPA). Diphenylamine is used in a nitrocellulose gas generating material at levels below about 0.7% by weight of the gas generating material. This level is not effective to retard the decomposition of nitrocellulose when nitrocellulose is exposed to elevated temperatures (i.e., above about 65° C.). Further, simply increasing the level of stabilizer combined with nitrocellulose does not retard the decomposition of nitrocellulose. Higher levels of diphenylamine seem to accelerate the decomposition of nitrocellulose. The accelerated decomposition of stabilized nitrocellulose at elevated temperatures appears to be caused by the basic and/or nucleophilic properties of diphenylamine.

SUMMARY OF THE INVENTION

The present invention is an apparatus that comprises a vehicle occupant protection device and a gas generating material. The gas generating material upon combustion produces a gas product that actuates the vehicle occupant protection device. The gas generating material comprises a single-base nitrocellulose composition that includes greater than about 2%, by weight of the single-base nitrocellulose composition, stabilizer. The stabilizer is a urea of an aromatic amine.

BRIEF DESCRIPTION OF THE DRAWINGS

The foregoing and other features of the present invention will become more apparent to one skilled in the art upon consideration of the following description of the invention and the accompanying drawing in which.

DESCRIPTION OF PREFERRED EMBODIMENTS

Figure 1:
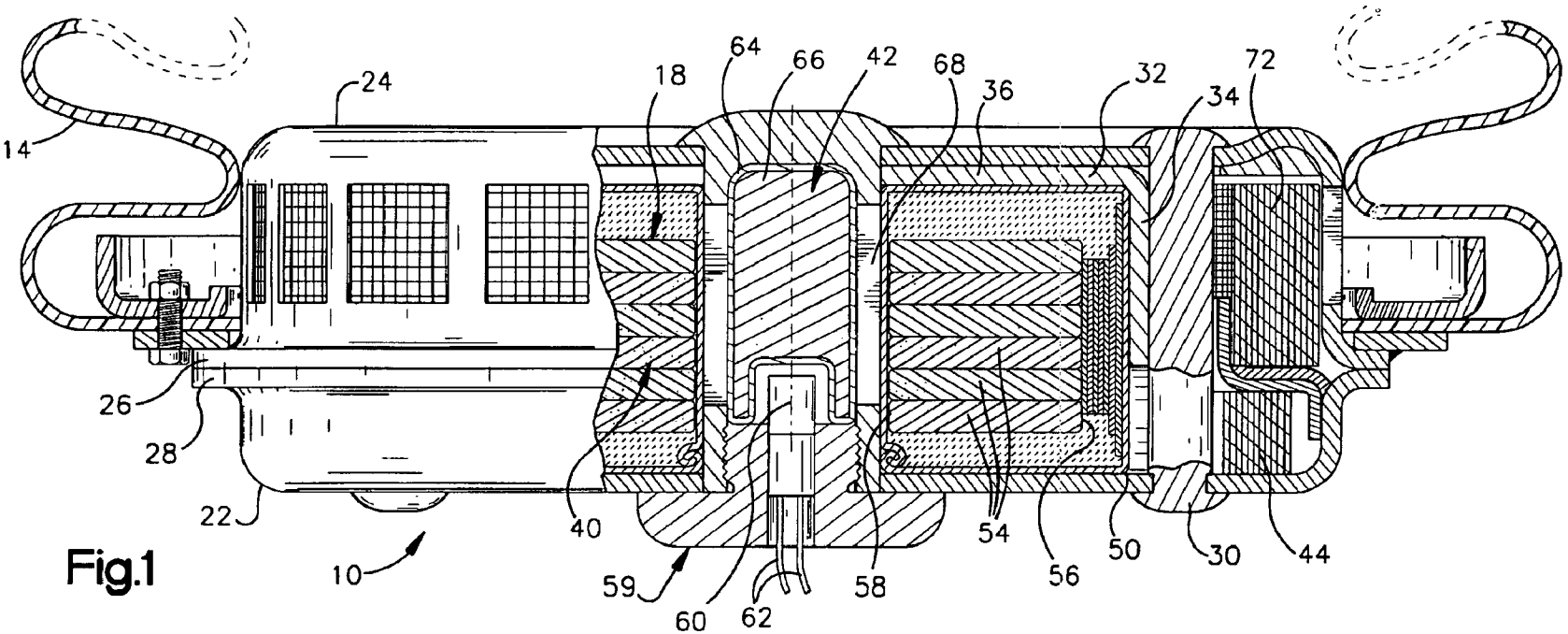
FIG. 1 is a sectional view of a pyrotechnic inflator according to an embodiment of the present invention.
Figure 2:
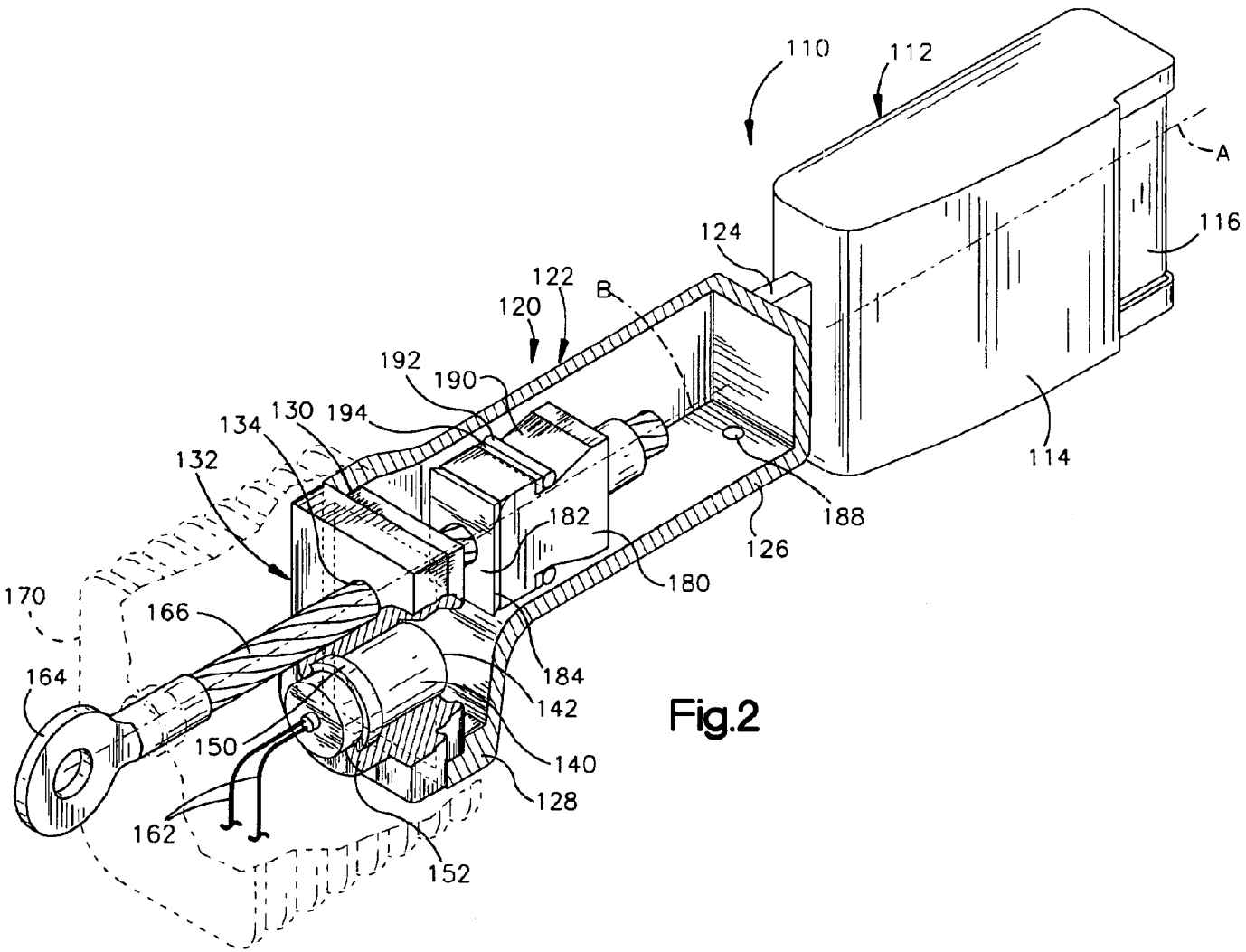
FIG. 2 is a sectional view of a buckle assembly for a vehicle safety belt system including a pretensioner according to another embodiment of the present invention.

A gas generating material comprises a single-base composition. By single-base composition, it is meant a gas generating composition that contains primarily nitrocellulose and does not include an energetic plasticizer (i.e., a double-base composition) or an energetic plasticizer and a crystalline fuel, such as nitroguanidine, (i.e., a triple-base composition). The single-base composition produces a large volume of gas upon combustion (i.e., greater that 0.03 moles of gas per gram of single-base composition) and sustains combustion without the addition of an oxidizer source. The single-base composition also upon combustion produces gas that is essentially free of particulates.

The nitrocellulose used in the single-base composition has a minimum nitrogen content of at least about 12.5% by weight of the nitrocellulose. Preferably, the nitrocellulose used in the single-base composition has a nitrogen content of about 12.6% to about 13.6% by weight of the nitrocellulose.

The amount of nitrocellulose in the single-base composition is about 85% to about 97% by weight of the single-base composition. Preferably, the amount of nitrocellulose in the single-base composition is about 90% to about 95% by weight of the single-base composition.

The single-base composition also includes a stabilizer that substantially retards the decomposition of the nitrocellulose at elevated temperatures (i.e., greater than about 65° C.). The stabilizer is a urea derivative of an aromatic amine. The urea derivative of an aromatic amine retards decomposition of the nitrocellulose by removing oxides of nitrogen, which are formed upon exposing the nitrocellulose to elevated temperatures. Examples of a urea derivative of an aromatic amine are ethyl centralite, 1,1-diphenylurea (Akardite), 1,1-diphenyl-3-methyl-urea (Akardite II), and mixtures thereof.

It is critical that the amount of stabilizer in the single-base composition is greater than 2% by weight of the single-base composition. An amount of stabilizer less than or equal to 2% by weight of the single-base composition is insufficient to retard substantially the decomposition of the nitrocellulose in the single-base composition when the single-base composition is exposed to temperatures above about 65° C. A preferred amount of stabilizer in the gas generating composition is from about 3% to about 5% by weight of the single-base composition.

The single-base composition can also include other ingredients commonly added to a single-base composition to improve the combustion properties and processing of the single-base composition. Examples of these other ingredients include flash suppressants, such as potassium sulfate, and non-energetic plasticizers, such as butyl stearate. The amount of these other ingredients in the single-base composition is less than 10% by weight of the single-base composition. Preferably, the amount of these other ingredients in the single-base composition is less than 5% by weight of the single-base composition.

The single-base composition is preferably prepared by solvent extrusion processing. In solvent extrusion processing, nitrocellulose having the required nitrogen content and wet with about 30% water is transferred to a double-acting hydraulic dehydration press, and compressed at low pressure to remove some of the water. The remaining water is removed by pumping a 95% ethyl alcohol/5% water solution and ether through the nitrocellulose. The nitrocellulose is pre-mixed with the stabilizer in a sigma-bladed water-jacketed mixer and then later mixed with the other ingredients, if utilized, until a colloidal mixture is formed. The temperature is kept below about 25° C. during mixing. The colloidal mixture looks like moist crude sugar. The colloidal mixture is macerated to increase the homogeneity of the mixture.

After maceration, the colloidal mixture is transferred to a vertical block screening press where it is consolidated. The block of single-base composition is extruded at a relatively low pressure (i.e., 1500–2500 psi.) and dried to remove any remaining solvent and water.

Alternatively, the single-base composition can be prepared by solvent emulsion processing, solventless extrusion processing, and casting, all of which are known in the art.

The single-base composition can be utilized as the sole ingredient in the gas generating material. Optionally, the gas generating material can include additional materials commonly added to a gas generating material, such as burn rate modifiers, coolants, opacifiers, and desiccants. These additional materials are included in the gas generating material in relatively small amounts (i.e., less than about 10% by weight of the gas generating material).

When the additional materials are included in the gas generating material, the gas generating material preferably includes an oxidizer. The additional materials are typically oxygen deficient. By oxygen deficient, it is meant that the additional materials require an additional oxygen source to combust completely. As a result, a gas generating material that consists of the single-base composition and the additional materials will tend to produce a combustion product that potentially includes carbon monoxide and nitrogen oxides. It is therefore necessary, when the additional materials are included in the gas generating material, that the gas generating material further include an oxidizer to oxygen balance the gas generating material.

The oxidizer can be any oxidizer commonly used in a gas generating material for inflating a vehicle occupant protection device. A preferred oxidizer is an inorganic salt oxidizer. Examples of inorganic salt oxidizers that can be used in a gas generating material for inflating a vehicle occupant protection device are alkali metal nitrates such as sodium nitrate and potassium nitrate, alkaline earth metal nitrates such as strontium nitrate and barium nitrate, alkali metal perchlorates such as sodium perchlorate, potassium perchlorate, and lithium perchlorate, alkaline earth metal perchlorates, alkali metal chlorates such as sodium chlorate, lithium chlorate and potassium chlorate, alkaline earth metal chlorates such as magnesium chlorate and calcium chlorate, ammonium perchlorate, ammonium nitrate, and mixtures thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds, modifiers, and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or alkaline earth metal salt are ammonium perchlorate and sodium nitrate, ammonium perchlorate and potassium nitrate, and ammonium perchlorate and lithium carbonate. Ammonium perchlorate produces upon combustion hydrogen chloride. A non-halogen alkali metal or an alkaline earth metal salt will react with the hydrogen chloride produced upon combustion to form an alkali metal or an alkaline earth metal chloride. Preferably, the non-halogen alkali metal or alkaline earth metal salt is present in an amount sufficient to produce a combustion product that is substantially free (i.e., less than 2% by weight of the combustion product) of hydrogen chloride.

The oxidizer material is incorporated in the gas generating material in the form of particles. The average particle size of the oxidizer material is less than about 100 microns. Preferably, the average particle size of the oxidizer material is from about 10 microns to about 30 microns.

The amount of oxidizer in the gas generating material is that amount necessary to oxygen balance the gas generating material so that the carbon and hydrogen in the gas generating material are converted upon combustion to carbon dioxide and water, respectively. The amount of oxidizer to oxygen balance the gas generating material is from 0 to about 25% by weight of the gas generating material. A preferred amount is less than about 15% by weight of the gas generating material.

The gas generating material can be prepared by extruding the single-base composition or compacting particles of the single-base composition into the configuration of the gas generating disks 54 or into some other configuration. If included in the gas generating material, the additional materials (i.e., oxidizers, burn rate modifiers, coolants, opacifiers, and/or desiccants) are mixed as particles with the single-base composition prior to extrusion or with particles of the single-base composition prior to compacting.

In accordance with one embodiment of the present invention, the gas generating material is utilized in a vehicle occupant protection apparatus. Referring to FIG. 1, the vehicle occupant protection apparatus 10 includes an inflatable vehicle occupant protection device 14 and an inflator 12 that is actuatable to inflate the inflatable vehicle occupant protection device 14.

The specific structure of the inflator 12 can vary. The inflator 12 comprises a base section 22 and a diffuser section 24. The two sections 22 and 24 are joined together at mounting flanges 28 and 26, which are attached to each other by a continuous weld (not shown). A plurality of rivets 30 also hold the diffuser section 24 and the base section 22 together.

A combustion cup 32 is seated between the diffuser section 24 and the base section 22. The combustion cup 32 comprises an outer cylindrical wall 34 and an annular top wall 36. The combustion cup 32 divides the inflator 10 into a combustion chamber 40, which is located within the combustion cup 32, and a filtration chamber 44, which is annular in shape and is located outside the combustion cup 32.

The combustion chamber 40 houses an inner container 50, which is hermetically sealed. The inner container 50 holds the gas generating material 18, which is in the form of a plurality of gas generating disks 54. The gas generating disks 54 have a generally toroidal configuration with a cylindrical exterior surface 56 and an axially extending hole defined by a cylindrical interior surface 58. The disks 54 are positioned in the container in a stacked relationship with the axially extending holes in alignment. Each disk 54 has generally flat opposed surfaces and may have protuberances on such surfaces to space one disk slightly from another. This configuration of the disks 54 promotes a uniform combustion of the disks 54. The gas generating material could, alternatively, be provided in the form of pellets or tablets.

The cylindrical interior surfaces 58 of the disks 54 encircle an ignition chamber 42. The ignition chamber 42 is defined by a two-piece, tubular igniter housing 59 that fits within the combustion cup 32 and the disks 54 and contains a squib 60. The squib 60 contains a small charge of ignitable material (not shown). Electric leads 62 convey a current to the squib 60. The current is provided when the crash sensor 20, which is responsive to a condition indicative of a vehicle collision, closes an electrical circuit that includes a power source (not shown). The current generates heat in the squib 60, which ignites the ignitable material.

The ignition chamber 42 also contains 64 that contains a rapidly combustible pyrotechnic material 66, such as boron potassium nitrate. The rapidly combustible pyrotechnic material 66 is ignited by the small charge of ignitable material of the squib 60. The burning pyrotechnic material 66 exits from the ignition chamber 42 through openings 68 in the igniter housing that lead to the combustion chamber 40. The burning pyrotechnic material 66 penetrates the container 50 and ignites the gas generating disks 54. Other ignition systems capable of igniting the disks 54 are well known and can be used with the present invention.

The inflator 12 also comprises a filter assembly 72 in a filtration chamber 44. The filter assembly 72 is in the flow path between the combustion chamber 40 and the vehicle occupant protection device 14. The filter assembly 72 functions to cool the products of combustion of the disks 54.

Upon occurrence of sudden vehicle deceleration indicative of a collision for which inflation of the inflatable vehicle occupant protection device 14 is desired, a crash sensor (not shown) transmits or causes a signal to be transmitted from a power source (not shown) to ignite the ignitable material. The burning ignitable material produces ignition products that ignite the pyrotechnic material 66. The burning pyrotechnic material 66 produces heat which ignites the gas generating disks 54. The gas generating disks 54 combust and produce heat and a combustion gas product. The combustion gas product flows through the filter assembly 72 and into the inflatable vehicle occupant protection device 14. The inflatable vehicle occupant protection device 14 is thus inflated to help protect a vehicle occupant from forcibly striking parts of a vehicle.

In accordance with another embodiment of the present invention the gas generating material is used in vehicle occupant seat belt system. The specific structure of the vehicle occupant seat belt system can vary. The vehicle occupant seat belt system includes a buckle assembly 110 and seat belt webbing (not shown). The buckle assembly 110 is attached to a component of the vehicle, such as a seat, floor or door pillar (not shown). The seat belt webbing is extendable about an occupant of a vehicle seat. The seat belt webbing carries a tongue (not shown), which is connectable with the buckle assembly 110 to secure the seat belt webbing about the occupant.

The buckle assembly 110 includes a buckle 112 having a cover 114, a moveable push button 116 extending through the cover, and a longitudinal axis A. The buckle 112 receives and latches the tongue to connect together the seat belt webbing and the buckle assembly 110. The buckle 112 is actuatable to release the tongue when the push button 116 is manually depressed.

The buckle assembly 110 includes a pretensioner 120. The pretensioner 120 is operatively connected with the buckle 112. The pretensioner 120 is automatically actuatable to tension the seat belt and tighten the seat belt against the occupant in response to a vehicle collision that requires tensioning of the seat belt and tightening of the seat belt against the occupant.

The pretensioner 120 includes a hollow housing 122, which is fixed to the buckle 112 by a connector 124. The connector 124 may be of any suitable length and extends in a direction substantially parallel to the axis A of the buckle 112. The housing 122 and the connector 124 are preferably made as one piece of metal, such as by die casting. The housing 122 has a longitudinal axis B, which is substantially coaxial with the axis A of the buckle 112. The housing 122 includes a tube portion 126, which has a rectangular inner periphery in a plane extending normal to the axis B.

The housing 122 also includes an enlarged end portion 128 extending from the tube portion 126. The tube portion 126 is in fluid communication with the enlarged end portion 128. The enlarged end portion 128 has an opening 130 to the left, as viewed in FIGS. 2–5. A first end wall or cap 132 is fixed in the opening 130 of the enlarged end portion 128 by suitable means, such as a weld or an adhesive. The cap 132 is preferably made from metal. A circular opening 134 extends through the end cap 132 around the axis B of the housing 122.

A gas generator 140 is supported by the end cap 132. The gas generator 140 includes a casing 142. The casing 142 has a generally cylindrical configuration including an axially extending side wall 144 (FIG. 5), first and second radially extending end walls 146 and 148 disposed at opposite ends of the side wall 144, and an annular flange 150 (FIG. 2) projecting radially from the side wall 144. An end portion 152 of the cap 132 is deformed over the flange 150 of the gas generator 140 to retain the gas generator 140 in the cap 132. The side wall 144 and the end walls 144 and 146 of the casing 142 define a combustion chamber 154 within the gas generator 140. The gas generating material 155 of the present invention is loaded in the combustion chamber 154. The gas generating material 155 occupies a substantial portion of combustion chamber 154.

The first radially extending end wall 146 supports an igniter 160. The igniter 160 contains an ignitable material (not shown). Electric leads 162 convey a current to the igniter 160 to ignite the ignitable material. The current is provided when a crash sensor (not shown), which is responsive to a condition indicative of a vehicle collision, closes an electrical circuit (not shown) that includes a power source (not shown).

An anchor 164 is secured to the component of the vehicle by a suitable fastener such as a bolt. A connector or cable 166 is fixed at one end to the anchor 164. The cable 166 is substantially inextendable in a direction along its length. The cable 166 extends through the opening 134 in the cap 132. The outer diameter of the cable 166 fits tightly in the opening 134, and the cable 166 forms a seal against the surface of the cap 132 defining the opening 134. It will be appreciated that a resilient seal could be provided in or at the opening 130 to engage the exterior of the cable 166. A bellows 170 is provided at the enlarged end portion 128 of the housing 122 to inhibit access to the cable 166, the igniter 160, and the enlarged end 128 of the housing 122. The buckle 112 is initially spaced from the anchor 164 a distance D1 prior to actuation of the pretensioner 120.

An end of the cable 166 opposite the end connected to the anchor 164 is connected to a second end wall or piston 180. The piston 180 has a rectangular outer periphery, in plane extending normal to the axis B of the housing 122, and closely fits within the tube portion 126 of the housing. The piston 180 cooperates with the housing 122 and the cap 132 to define an expansible chamber 182. A rectangular elastomeric gasket 184 is fixed to the piston 180 and engages the inner periphery of the tube portion 126. The gasket 184 inhibits fluid flow between the piston 180 and the surfaces defining the tube portion 126 of the housing 122.

The piston 180 and gasket 184 also cooperate with the tube portion 126 of the housing 122 to define a contractible chamber 186 on a side of the piston opposite the expansible chamber 182. A vent opening 188 is provided in the tube portion 126 of the housing 122. The vent opening 188 places the contractible chamber 186 in fluid communication with the environment external to the housing 122. Such fluid communication assures that fluid damping does not occur due to compression of fluid in the chamber 186 during movement of the piston 180 relative to the housing 122 when the chamber 182 expands.

In the event of a vehicle collision at or above a predetermined threshold level, the seat belt pretensioner is actuated. An electrical signal is communicated over wires 162 to the igniter 160. The igniter 160 is actuated and ignites the gas generating material 155. The gas generating material 155 produces combustion products, which rupture the end wall 148 of the casing 142 and flow from the gas generator 140 into the chamber 182 in the enlarged end portion 128 of the housing 122. The pressure of the combustion products in the chamber 182 applies a force to surfaces of the piston 180, tube portion 126 of the housing 122, enlarged end portion 128 of the housing, and cap 132, all of which define the chamber.

Figure 3:
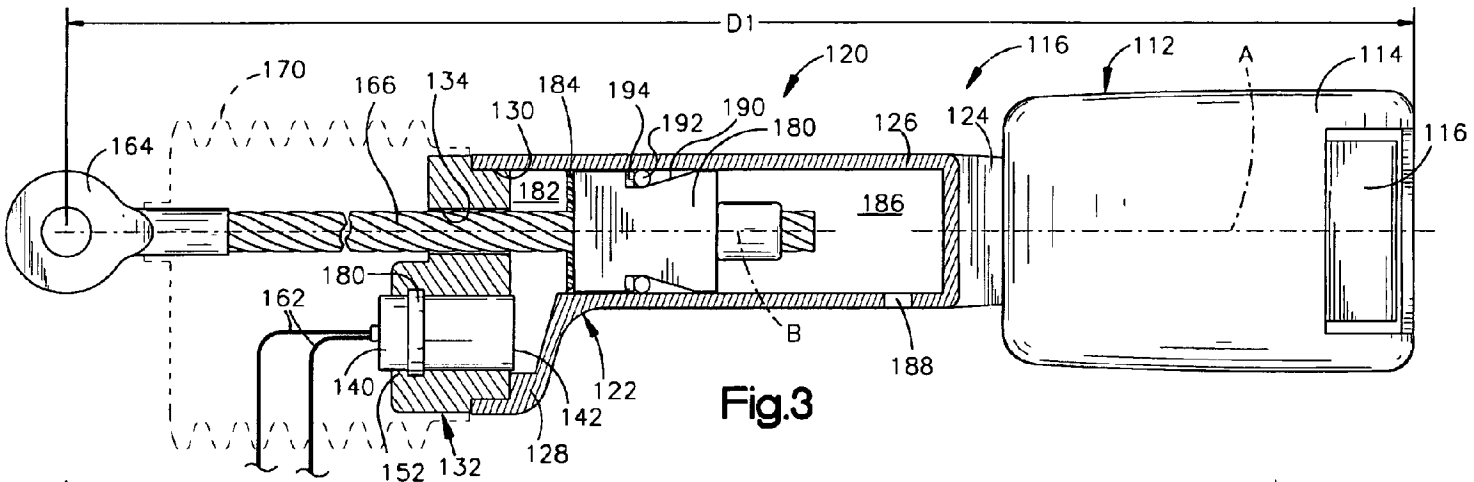
FIG. 3 is a sectional view of the buckle assembly of FIG. 2.
Figure 4:
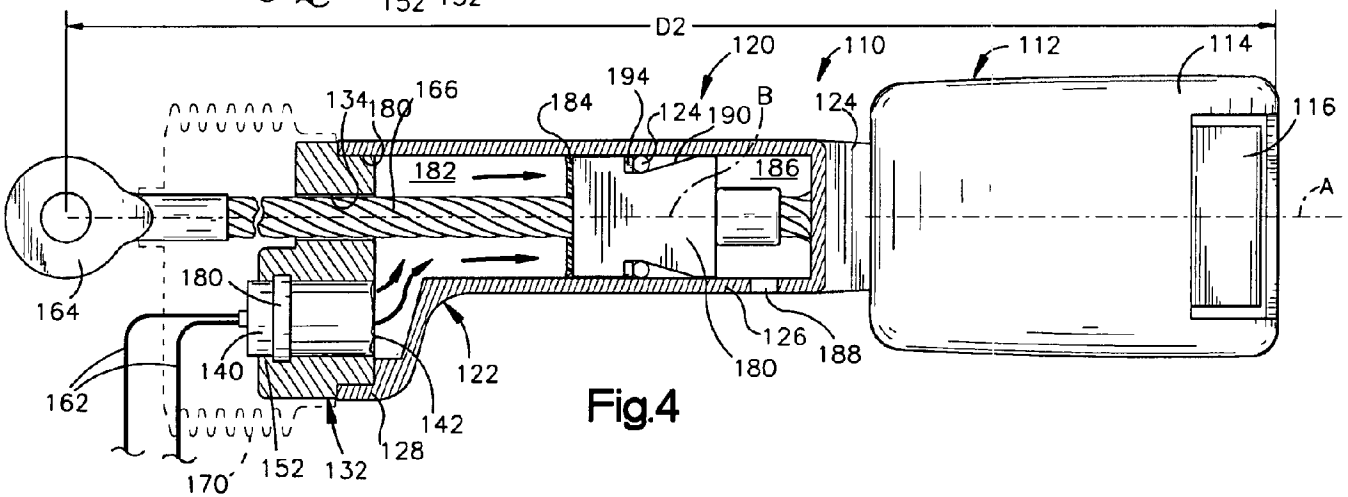
FIG. 4 is a view similar to FIG. 3 with parts illustrated in different positions.
Figure 5:
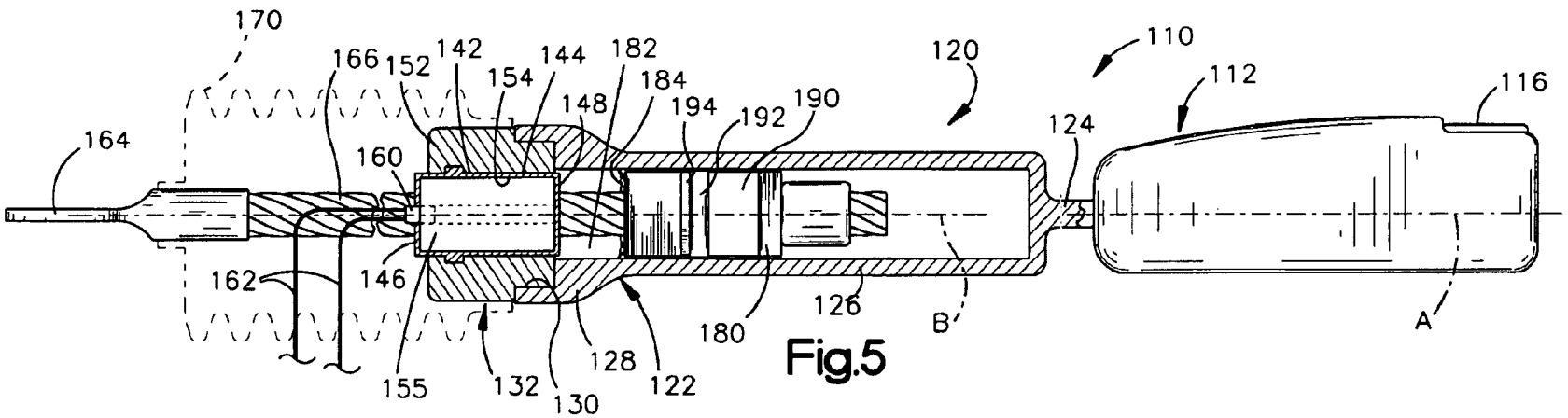
FIG. 5 is a sectional view of the buckle assembly of FIG. 2.

The force expands the chamber 182 by moving the housing 122, the cap 132 and the igniter 140 linearly to the left, as viewed in FIGS. 3–4, relative to the piston 180, the cable 166 and the anchor 164 and in a direction along axis A of the buckle 112. The chamber 186 contracts concurrently with expansion of the chamber 182. Fluid in the chamber 186 escapes through the vent opening 188 in the housing 122 upon contraction of the chamber when the piston 180 moves within the housing. Movement of the housing 122 to the left pulls the connector 124 and the buckle 112 in a direction towards the anchor 164 to tension the seat belt and tighten the seat belt against the occupant. The buckle 126 moves closer to the anchor 164 in a direction along the axis B of the housing 122, from the distance D1 (FIG. 3) to the distance D2 (FIG. 4).

The piston 180 has a pair of recesses 190 formed in opposite sides of the piston. Each recess 190 has a planar surface that extends at a relatively small angle relative to the axis B of the housing 122. A roller 192 and a resilient biasing gasket 194 are located in each recess 190. The rollers 192 and recesses 190 act on the tube portion 126 of the housing 122 to inhibit contraction of the chamber 182 but not expansion of the chamber.

From the above description of the invention, those skilled in the art will perceive improvements, changes and modifications in the invention. Such improvements, changes and modifications within the skill of the art are intended to be covered by the appended claims.

Having described the invention, the following is claimed:

1. An apparatus comprising;

a vehicle occupant protection device and a gas generating material, which upon combustion produces a gas product that actuates the vehicle occupant protection device, and an ignition material for igniting the gas generating material, the gas generating material comprising a single-base composition and being free of an energetic plasticizer; the single base composition consisting essentially of:

about 90 to about 95% by weight of the single-base composition nitrocellulose, about 3% to about 5% by weight of the single-base composition a stabilizer, the stabilizer being a urea of an aromatic amine, and less than about 5% by weight of the single-base composition a non-energetic plasticizer.

2. The apparatus of claim 1, wherein the gas generating material is oxygen balanced so that the carbon in the gas generating material is converted, upon combustion, to carbon dioxide and the hydrogen in the gas generating composition is converted, upon combustion, to water.

3. The apparatus of claim 1 wherein the urea of the aromatic amine is selected from the group consisting of ethyl centralite, 1,1-diphenylurea, 1,1-diphenyl-3-methylurea, and mixtures thereof.

4. An apparatus comprising;

a vehicle occupant protection device;

a gas generating material, which upon combustion produces a gas product that actuates said vehicle occupant protection device; said gas generating material consisting essentially of a single-base composition, said single-base composition including greater than 2%, by weight of the single-base composition, stabilizer, wherein said stabilizer is a urea of an aromatic amine; and an ignition material for igniting the gas generating material.

* * * * *